US006815066B2

(12) United States Patent
Elliott

(10) Patent No.: US 6,815,066 B2
(45) Date of Patent: Nov. 9, 2004

(54) COMPOSITE MATERIAL CONTAINING TUNGSTEN, TIN AND ORGANIC ADDITIVE

(76) Inventor: Kenneth H. Elliott, 157 Nichol Road, R. R. #2, Baltimore, Ontario (CA), K0K 1C0

( * ) Notice: Subject to any disclaimer, the term of this patent is extended or adjusted under 35 U.S.C. 154(b) by 179 days.

(21) Appl. No.: 10/132,262

(22) Filed: Apr. 26, 2002

(65) Prior Publication Data

US 2003/0027005 A1 Feb. 6, 2003

Related U.S. Application Data

(60) Provisional application No. 60/286,361, filed on Apr. 26, 2001, and provisional application No. 60/329,306, filed on Oct. 16, 2001.

(51) Int. Cl.[7] ..... B32B 5/16; C22C 27/04

(52) U.S. Cl. ..... 428/407; 420/430; 420/557

(58) Field of Search ..... 428/402, 403, 428/407, 328; 420/403, 557; 429/1, 10

(56) References Cited

U.S. PATENT DOCUMENTS

| | | | | |
|---|---|---|---|---|
| 5,279,787 | A | 1/1994 | Oltrogge | 419/38 |
| 5,399,187 | A | 3/1995 | Mravic | 75/102 |
| 5,540,749 | A | 7/1996 | Li | 75/102 |
| 5,719,352 | A | 2/1998 | Griffin | 102/517 |
| 5,728,349 | A | 3/1998 | Persson | 420/102 |
| 5,760,331 | A | 6/1998 | Lowden | 102/75 |
| 5,763,819 | A | 6/1998 | Huffman | 102/510 |
| 5,789,698 | A | 8/1998 | Beal | 102/516 |
| 5,814,759 | A | 9/1998 | Mravic | 102/75 |
| 5,847,313 | A | 12/1998 | Beal | 102/516 |
| 5,877,437 | A | 3/1999 | Oltrogge | 75/228 |
| 5,894,644 | A | 4/1999 | Mravic | 29/102 |
| 5,913,256 | A | 6/1999 | Lowden | 75/102 |
| 5,950,064 | A | 9/1999 | Robinson | 419/47 |
| 5,963,776 | A | 10/1999 | Lowden | 419/102 |
| 6,016,754 | A | 1/2000 | Enlow | 102/516 |
| 6,048,379 | A | 4/2000 | Bray | 75/428 |
| 6,074,454 | A | 6/2000 | Abrams | 75/102 |
| 6,085,661 | A | 7/2000 | Halverson | 102/516 |
| 6,090,178 | A | 7/2000 | Benini | 75/102 |
| 6,149,705 | A | 11/2000 | Lowden | 75/240 |
| 6,174,494 | B1 | 1/2001 | Lowden | 419/102 |
| 6,248,150 | B1 | 6/2001 | Amick | |
| 6,257,149 | B1 | 7/2001 | Cesaroni | |
| 6,263,798 | B1 | 7/2001 | Benini | |
| 6,300,399 | B1 | 10/2001 | Gallucci et al. | |
| 6,517,774 | B1 * | 2/2003 | Bray et al. | 419/65 |

(List continued on next page.)

FOREIGN PATENT DOCUMENTS

| | | |
|---|---|---|
| CA | 2202632 | 4/1996 |
| CA | 2248282 | 10/1997 |
| CA | 2095232 | 1/2000 |
| GB | 531389 | 1/1941 |
| WO | WO 86/04135 | 7/1986 |
| WO | WO 88/09476 | 12/1988 |
| WO | WO 93/22470 | 11/1993 |
| WO | WO 00/37878 | 6/2000 |

OTHER PUBLICATIONS

Masami Aihara Harima Chemicals, Inc. "Low–Temperature Lead–free Solder" (slides 1–7), 2004.*

"Tungsten outflanks lead" *The International Journal of Powder Metallugy* (2001) 37(1):20.

Lyndon Edwards and Mark Endean (eds.), *Manufacturing with Materials*, 1990.

K.G. Swift and J.D. Booker, *Process Selection: From Design to Manufacture*, 1997, pp. 207 to 220 and flash card entitled "Pressing and Sintering".

*Primary Examiner*—H Thi Le

(74) *Attorney, Agent, or Firm*—Anissimoff & Associates

(57) ABSTRACT

A composite material for use as a lead replacement, comprising a high density metal such as tungsten (W), a lower density metal such as tin (Sn) and an organic additive is disclosed. Also disclosed are processes for forming such composites. The composite is particularly useful in ammunition.

17 Claims, 6 Drawing Sheets

U.S. PATENT DOCUMENTS 6,527,824 B2 * 3/2003 Amick ..... 75/248
6,530,328 B2 * 3/2003 Burczynski et al. ..... 102/507
6,536,352 B1 * 3/2003 Nadkarni et al. ..... 102/506
6,551,375 B2 * 4/2003 Siddle et al. ..... 75/248
2001/0050020 A1 12/2001 Davis et al.
2002/0005137 A1 1/2002 Stone
2002/0124759 A1 9/2002 Amick

* cited by examiner

COMPOSITE MATERIAL CONTAINING TUNGSTEN, TIN AND ORGANIC ADDITIVE

CROSS-REFERENCE TO RELATED APPLICATIONS

This application claims the benefit of U.S. Provisional Application No. 60/286,361, filed Apr. 26, 2001 and U.S. Provisional Application No. 60/329,306 filed Oct. 16, 2001.

FIELD OF THE INVENTION

This invention relates to composite materials, particularly to composite materials that can be used as lead replacements.

BACKGROUND OF THE INVENTION

Lead has been used in a variety of industrial applications for many thousands of years. In the last hundred years, the toxic effects of lead have become apparent. In an effort to reduce reliance on lead, there has recently been extensive research into materials that could be used to replace lead.

In this regard, much effort has been focussed on producing metal composites that mimic the properties of lead. Since the density of lead is the most obvious characteristic to mimic, most efforts have concentrated on finding composites that have the same or similar density as lead. However, other important properties of lead have been largely ignored and, as a result, no completely satisfactory lead replacement has yet been found.

In addition to being non-toxic and to having a similar density to lead, a successful composite should have reasonable softness coupled with structural rigidity. Ideally the composite is substantially homogeneous and relatively cheap to manufacture in large quantities.

One of the uses of lead has been in the manufacture of ammunition such as bullets and shot for shotguns. However, due to the increasing problem of lead contamination in the environment, arms manufacturers have begun looking for lead alternatives.

In a recent article, it has been reported that tungsten/tin and tungsten/nylon composites hold promise as lead replacements in ammunition ("Tungsten Outflanks Lead" *The International Journal of Powder Metallurgy* (2001) 37 (1):20)

Canadian patent 2,095,232 discloses an environmentally improved shot in which a lead or metal composite core is coated with an inert polymer like Teflon™.

Canadian patent application 2,202,632 discloses a ferromagnetic bullet that comprises a composite of a dense metal such as tungsten (W) or ferrotungsten with a lighter metal such as tin (Sn) or with a polymer such as phenyl formaldehyde or polymethylmethacrylate. A combination of tungsten, tin and polymer is not disclosed.

Canadian patent application 2,248,282 discloses a bullet core comprising a composite of a thermoplastic polymer and a metal filler such tungsten, bismuth or tin.

U.S. Pat. Nos. 5,279,787 and 5,877,437 disclose metal composites made from a mixture of a high density metal powder such as tungsten and a low density metal powder such as tin. Projectiles or shot are formed by moulding or drop forming.

U.S. Pat. Nos. 5,399,187 and 5,814,759 disclose lead-free bullets comprising a composite of a heavy constituent such as ferrotungsten or tungsten and a lighter constituent such as tin or a polymer such as phenyl formaldehyde or polymethylmethacrylate. A combination of tungsten, tin and polymer is not disclosed. This reference particularly exemplifies the use of ferrotungsten in combination with either a polymer or a low density metal, but not with both a polymer and a low density metal.

U.S. Pat. No. 5,719,352 discloses a low toxicity shot pellet comprising a composite of a mixture of finely divided molybdenum and tungsten particles in a polymer matrix such as polystyrene.

U.S. Pat. Nos. 5,760,331, 6,149,705 and 6,174,494 disclose lead-free bullets comprising a composite of a heavy constituent such as tungsten and a lighter constituent such as tin, aluminum, copper or zinc.

U.S. Pat. No. 5,894,644 discloses a lead-free bullet comprising a composite of a heavy metal such as tungsten and a lighter metal such as tin which is made by the infiltration of the lighter metal into a pre-form of the heavy metal.

U.S. Pat. Nos. 5,913,256 discloses a non-lead projectile comprising a composite of a heavy metal such as tungsten and a lighter metal such as tin together with a wetting agent such as aluminum or zinc.

U.S. Pat. No. 5,963,776 discloses a projectile comprising a composite of a heavy metal such as tungsten and a lighter metal such as tin, the composite being made by a process in which the lighter metal is coated on the heavy metal and the two are cold pressed.

U.S. Pat. No. 6,048,379 discloses a high density material comprising tungsten, a binder such as nylon and a fibrous material such as stainless steel fibres. The material is used for lead replacement.

SUMMARY OF THE INVENTION

There is provided a composite comprising tungsten, tin and an organic additive.

The composite of the present invention is generally in solid form. Throughout this specification, "solid object" has reference to a composite of the present invention in solid form.

In another aspect, there is also provided a process for preparing a solid object comprising:

mixing tungsten, tin and an organic additive to form a mixture; and forming a solid object of tungsten, tin and an organic additive from the mixture.

In another aspect, this process may further comprise the steps of:

coating the solid object with a low surface energy organic polymer; and heating the coated solid object to a temperature greater than the melting point of the tin.

The composites of this invention can be used to completely or partially replace lead in a variety of articles such as projectiles or ammunition (for example, bullets, bullet cores and shot), weights (for example, wheel weights), radiation shielding, vibration damping supports or sports products (for example, golf club heads or dart bars).

DESCRIPTION OF THE PREFERRED EMBODIMENTS

Tungsten is preferably used in the composite in an amount of about 40–74%, more preferably about 55–69%, by weight of the composite. In a process for preparing the composite, tungsten is generally used in the form of tungsten particles, particularly in powder form. The relatively lower fraction of tungsten in the composite allows a greater processing window to achieve the target density, resulting in, at least in principle, an increased number of options in terms of particle size, shape and purity as compared to the use of deagglomerated, high purity tungsten with an average particle size of 4 $\mu$m, which is typically used in prior art tungsten/polymer composites.

Tin is preferably used in the composite in an amount of about 25–59%, more preferably about 30–44%, by weight of the composite. Generally, tin can be used in particulate form in a process to prepare the composite. Some alloying (generally <10%) may be done to adjust the processing characteristics in terms of wetting, and melting, as well as mechanical properties of the final product.

The ratio of tungsten to tin is generally adjusted to provide a composite with a density of about 9.5 to 14.0 g/cc. Ideally the density of the composite is about 11.3 g/cc, which is the density of lead. However, variations from the ideal density will still result in a useful composite.

The organic additive can be any organic substance that imparts a desired characteristic to the composite. The organic additive may be used, for example, as a binder, to increase lubricity (e.g., to reduce damage to a gun barrel when the composite is used in ammunition), to modify mechanical properties, to modify the wettability of tin and/or tungsten, to control viscosity or to inhibit the settling of tungsten in the composite. The organic additive may, for example, be a metal (e.g., zinc, lithium, nickel or copper) stearate or ethylene-bis-stearamide.

The organic additive may also be an organic polymer. If such is the case, ideally, desired characteristics can be imparted by a single organic polymer, but, separate polymers may be used to impart one or more of the desired characteristics to the composite. Polymer blends or copolymers may also be used as the organic polymer.

The organic polymer is preferably a thermoplastic polymer. Specific organic polymers include, but are not limited to, polyfluorinated hydrocarbons such as polytetrafluoroethylene (PTFE, e.g. Teflon™, DryFilm™), and ethylenechlorotrifluoroethylene (ECTFE), basic polymers such as polyamines and polyvinylpyrrolidone, and polypropylene. Polyfluorinated hydrocarbons are preferred, in particular, PTFE and ECTFE.

The organic additive is generally used in an amount of about 0.1–2.0%, preferably about 0.5–1.0%, by weight of the composite. Since the addition of organic polymer decreases the density of the composite, more tungsten is needed to offset the decrease in density. For this reason, it is preferred to use a minimum amount of polymer in order to keep the amount of tungsten as low as possible, since tungsten is the most expensive constituent of the composite.

In one embodiment, tungsten, tin and the organic additive may be intimately mixed so as to form a substantially homogeneous composite.

The composite may include other additives that perform a variety of functions. For example: mould releasing agents such as zinc stearate help with removing a formed article from a mould; lubricants such as ethylene-bis-stearamide, molybdenum disulfide, graphite or calcium difluoride may help reduce wear on objects in contact with the composite; modification of mechanical properties of the composite may be achieved using polypropylene or other polymers; a hardening agent such as antimony metal may be added; a strengthening agent such as bismuth metal may be added; modification to the wettability of tin and/or tungsten may be achieved using aluminum metal, copper metal, silver metal or basic polymers such as polyamines or polyvinylpyrrolidones. Basic polymers contain alkaline functional groups which are capable of interacting with metals (which are generally acidic) thus providing a means for maintaining a more intimate interaction between the particles of different kinds of metals. This in turn may result in a more homogeneous composite.

In one preferred aspect, the composite consists essentially of tungsten, tin, organic additive and, optionally, any other additives that may be used. However, it is evident to one skilled in the art that incidental impurities may be present in the composite without unduly affecting the properties of the composite.

Composites of the present invention retain softness due to the tin but have structural rigidity due to the tungsten. This is particularly useful when the composite is to be used in ammunition since damage to gun barrels would be reduced or eliminated. Since the composite of the present invention requires the use of less tungsten than composites having only tungsten or other tungsten/polymer composites, the cost of manufacturing articles using the present composite may be substantially reduced. Homogeneity of the composite of the present invention may provide for better and more consistent mechanical properties than existing composites of a similar nature. This would be particularly useful when the composite is used in ammunition as the ammunition would have better ballistic properties.

With respect to the processing or preparation of the solid object, a concern relates to the idea of recrystallization after deformation. One of the reasons lead is such a good material for many applications is that it retains its softness even after deformation. This is due to the continuous relaxation of lead's crystal lattice even at room temperature. Normally when a metal is deformed, the energy of deformation is stored in the crystal lattice of the metal, resulting in hardening of the metal. Heat treatment or annealing is often necessary to relax the crystal structure of metals that have become hard due to the absorption of deformation energy. Lead does not retain excess deformation energy thereby remaining soft after deformation without the need for heat treatment or annealing. Processes of the present invention produce composites that mimic these properties of lead.

The wettability of tin and tungsten are important parameters in the processing of the composite. Good wettability promotes homogeneous mixing which results in a more uniform product that is stronger and less prone to shattering. Therefore, the wettability of tin and/or tungsten is preferably adjusted to promote homogeneous mixing. One strategy is to improve the wettability of tin on tungsten using suitable surface modifiers as described previously. Other important parameters that may play a role in the processing of the composite include inhibition of settling and viscosity control. Parameter control may be achieved through control of oxide formation, surface chemical composition and alloying of tin, for example.

Composites fabricated from mixtures of tin-tungsten powders, where no organic additive is present, are typically brittle when compacted or sintered below the melting point of tin. Above the melting point of tin, the tin may ooze out from composite owing to low wettability of tin on tungsten. The capillary forces are not strong enough to retain the molten tin between the tungsten particles.

Generally, a number of processes may be used to make composites of the present invention, aspects of which are generally disclosed in *Manufacturing with Materials*, eds. Lyndon Edwards and Mark Endean, 1990, Butterworth-Heinemann, Oxford, UK; and, *Process Selection: From*

*Design to Manufacture*, K. G. Swift and J. D. Booker, 1997, Arnold Publishers, London, UK, the disclosures of which are hereby incorporated by reference.

Polymer-assisted extrusion, tape casting and Powder Injection Molding (PIM) are examples of techniques that may be used. These techniques involve the initial mixing of the ingredients including the organic additive to form a suspension followed by moulding the suspension in a mould. The organic additive contributes fluidity to the composite thus permitting the forming of shapes. These approaches combine the processability of plastics and the superior material properties of metals and ceramics to form high performance components.

Extrusion and injection moulding are typically done at elevated temperatures (typically about 250° C. to about 270° C.) so that the tin and organic additive are initially in the molten or semi-solid state to facilitate the mixing of tungsten. Extrusion is generally a melt-processing technique that involves mixing the metal constituents and the organic additive at an elevated temperature followed by extruding the molten mixture through an open die into the form of wires, sheets or other simple shapes. Tape casting usually involves mixing metal constituents with a solution of organic additive and extruding the mixture at room temperature into sheets. These techniques are fairly slow for the commercial production of shot but may be most applicable to the manufacture of products like wheel weights, and bullets. Injection moulding is particularly useful for manufacturing wheel weights and bullets.

In recent years, PIM has emerged as a method for fabricating precision parts in the aerospace, automotive, microelectronics and biomedical industries. The important benefits afforded by PIM include near net-shape production of complex geometries in the context of low cost and rapid fabrication at high production volumes. PIM combines the processability of plastics and the superior material properties of metals and ceramics to form high performance components.

The overall PIM process consists of several stages. Metal or ceramic powder and organic materials that may include waxes, polymers and surfactants are combined to form a homogeneous mixture that is referred to as the feedstock. Ideally, the feedstock is a precisely engineered system. The constituents of the feedstock are selected and their relative amounts are controlled in order to optimize their performance during the various stages of the process. Injection of the feedstock is typically done at elevated temperatures (typically between 100° C. to about 350° C., more typically between 100° C. to about 250° C.). The molten feedstock is used to mould parts in an injection moulding machine, in a manner similar to the forming of conventional thermoplastics. While PIM is a suitable technique for the manufacture of products like wheel weights and bullets, it is generally too slow for the mass production of shot.

Another technique is die compaction, which involves the compaction of composite ingredients including an organic additive to form a compact. If no organic additive is present, compaction to high density can result in failure of the tool used to form the object during pressing or failure of the object being formed when attempting to eject the object from the tool. The composite ingredients are mixed and pressed into the desired shape. During the shape forming step, which is usually over a very short time period, the composite mixture may be heated to a temperature below the melting point of tin. Preferably the temperature is well above room temperature (e.g., above 100° C.) to about ⅔ the melting point of tin. The compact may then be sintered at an elevated temperature, usually for an extended period at a temperature between the melting point of tin and the actual melting point of tin, for example from about 154° C. to about 230° C., or the compact may be used without sintering.

On a general note, the term "sintering" refers to a solid state diffusion process whereby with temperature one achieves atomic diffusion of elements between particles in the composite, i.e. there is no liquid state. However the term "liquid phase sintering" is used when some parts of the composite actually melt and then rapidly alloy with other parts of the composite forming a solid.

A variation of the die compaction technique involves the compaction or pre-forming of tungsten into a porous tungsten compact or pre-form followed by the infiltration of organic polymer and tin (together with any other additive that may be used). In this variation, tungsten powder is typically sintered into the desired shape and a molten suspension of tin, organic additive and any other additives is permitted to infiltrate the porous tungsten compact or pre-form to form the composite.

In yet another technique, particularly adapted to producing shot, the ingredients of the composite including organic additive are mixed together and melted to form a suspension and the molten composite is dripped into small spheres. This technique may have problems relating to homogeneity of the resulting composite.

Heading or roll-forming techniques, either cold or warm, are more rapid than casting, moulding, pre-forming or dripping techniques and are ideally suited to the manufacture of ammunition, such as shot, since high throughput is required to make the process more economical. Generally, tin, tungsten and the organic additive may be mixed to form a suspension and extruded to form a wire, strip or sheet. The wire, strip or sheet may then be processed into the desired article. For the production of shot, the wire, strip or sheet is stamped or rolled out to give substantially or essentially spherical composite particles. Press rolls may also be used to press the extruded composite into a desired thickness before the spherical composite particles are formed. The spherical composite particles may then be finished to produce shot.

In such heading or roll-forming processes, tungsten, tin and organic additive may be pre-mixed to form a pre-mixture and charged to an extruder; or, they may be pre-mixed then compounded and pelletized, and charged to an extruder. Pre-mixing is generally done at ambient (room) temperature. Tin and organic additive, together with any other additives that may be used, are typically mixed first to form a tin/organic additive mixture (binder) which is then mixed with tungsten to from the pre-mixture. Compounding and pelletization is typically done at a temperature of from about 150° C. to about 210° C. In another aspect, a tin/organic additive mixture (binder) may be charged to an extruder and tungsten inducted during extrusion. The suspension to be extruded may be extruded cold, or, preferably, may be heated into a molten or semi-solid state and maintained at an elevated temperature (typically at about 250° C. to about 270° C., but may be outside this range if an alloy of tin is being used). The presence of organic polymer greatly reduces the wear during forming.

In yet another aspect of the heading or roll-forming process, a suspension of tungsten in molten tin and organic additive may be sprayed and the sprayed suspension fed into an extruder. In this latter aspect, the sprayed suspension is typically extruded at a temperature from about 200° C. to about 250° C. The lower extrusion temperature may help inhibit the settling of tungsten since tin would not be in the molten state.

The extruded composite, in the form of a wire, strip or sheet, may then be stamped progressively using a series or an array of punches to form regular indentations until the spherical composite particles are finally stamped out. Alternatively, spinning rolls with a dimpled texture may be used to form the spherical composite particles.

In general, following the shape forming stage, removal of organic constituents from a powder compact may be achieved, if desired, by pyrolysis prior to sinter densification of the component. The process of removal of the binders is referred to as debinding in general, and the pyrolysis method of binder elimination is termed as thermal debinding. In the present invention, removal of the organic polymer is not required.

Sinter densification is generally performed under a reducing atmosphere to prevent oxidation of the metal constituents. A reducing atmosphere may be achieved, for example, by using cracked ammonia gas or a mixture of 10% hydrogen and 90% nitrogen. For the tungsten/tin/organic additive composites of the present invention, sintering may also be done under an inert atmosphere, for example, under nitrogen or argon.

Another process that may be used to form the composites of the present invention is thixotropic forming. This process is generally applicable when using a tin alloy (e.g., tin-silver) of a certain composition which shows a melting point range. The temperature is held between the liquidus and the solidus at a point where the material contains both liquid and solid. In this zone the material behaves like "thick soup" and has the ability to entrap additive particles within the structure (i.e., tungsten). The mixture can then be extruded, die cast or injection moulded. During the forming operation the mixture cools rapidly thereby solidifying the mass and forming the composite of required composition.

A further method is capacitance discharge consolidation. In this process the selected powders (i.e., tungsten and tin or tin alloy) are blended and then compressed to shape. An electrical discharge is then passed across the compact still under pressure. Everywhere there is contact between the powders there will be high temperatures generated sufficient to cause localized melting and welding.

In another aspect of the present invention, the composite or solid object formed from any of the above processes may be subjected to a further process step, improving the wettability of tin on tungsten. The preferred method of forming the solid object is by die compaction where, during the shape forming step, the mixture is subjected to heating well above room temperature but below the melting point of the tin. The green tin-tungsten composite is then coated with a thin film of a low surface energy polymer. The low surface energy polymer preferably has a melting point above the melting point of tin (232° C.) or above the melting point of tin alloy if a tin alloy is used rather than pure tin. Particularly when pure tin is used, the melting point of the low surface energy polymer is preferably from about 232–300° C. Particularly preferred polymers are polyfluorinated hydrocarbons, especially the commercial fluoropolymer, polytetrafluoroethylene (PTFE) sold by DuPont under the name DryFilm™, which has a melting point of around 300° C.

The organic polymer may be coated onto the green tin-tungsten composite using a variety of techniques. For example, the composite may be dipped in a bath of fine polymer particles suspended in a solvent or a suspension of polymer particles may be sprayed onto the composite.

When the coated composite is heated above the melting point of tin, the polymer either acts as a physical barrier or as a result of its low surface energy prevents the liquid tin from escaping the composite. The temperature to which the coated composite is heated is preferably above the melting point of tin but preferably below the melting point of the organic polymer that is coated on the tin-tungsten mixture. As a result, improvement in the strength and malleability of the composite is observed. In this aspect of the invention, there may be no need to intimately mix any organic additive with the tin and tungsten, although this may be done as well. Organic polymer is present in the composite as a thin film that coats the tin-tungsten mixture. The polymer coat may be 0.1–50 microns thick, although more preferably 0.1–20 microns thick and yet more preferable 1 to 10 microns thick. The thickness of the polymer coat will depend on, for example, the coating times, particle size and coating concentration. The resultant coated tin-tungsten alloy may then be further processed using a variety of methods. The polymer coating may be removed (e.g., by physical, chemical or mechanical means known to a person of skill in the art) or it may remain as part of the composite to act as a lubricant in further use.

EXAMPLES

In the following examples, grade M65 (Osram Sylvania) tungsten powder was used having a density of 19.3 g/cc (helium pycnometry), 6.9 g/cc (tap density) and 4.5 g/cc (apparent density) and a median particle size of 25 $\mu$m. Where pure tin is specified (as opposed to an alloy thereof), grade L20 (OMG Americas) tin powder was used having a density of 7.28 g/cc (helium pycnometry) and 2.75 g/cc (apparent density) and a −325 mesh particle size.

Example 1

Composite—Intimate Mixing of Polymer by Die Compaction

Figure 1:
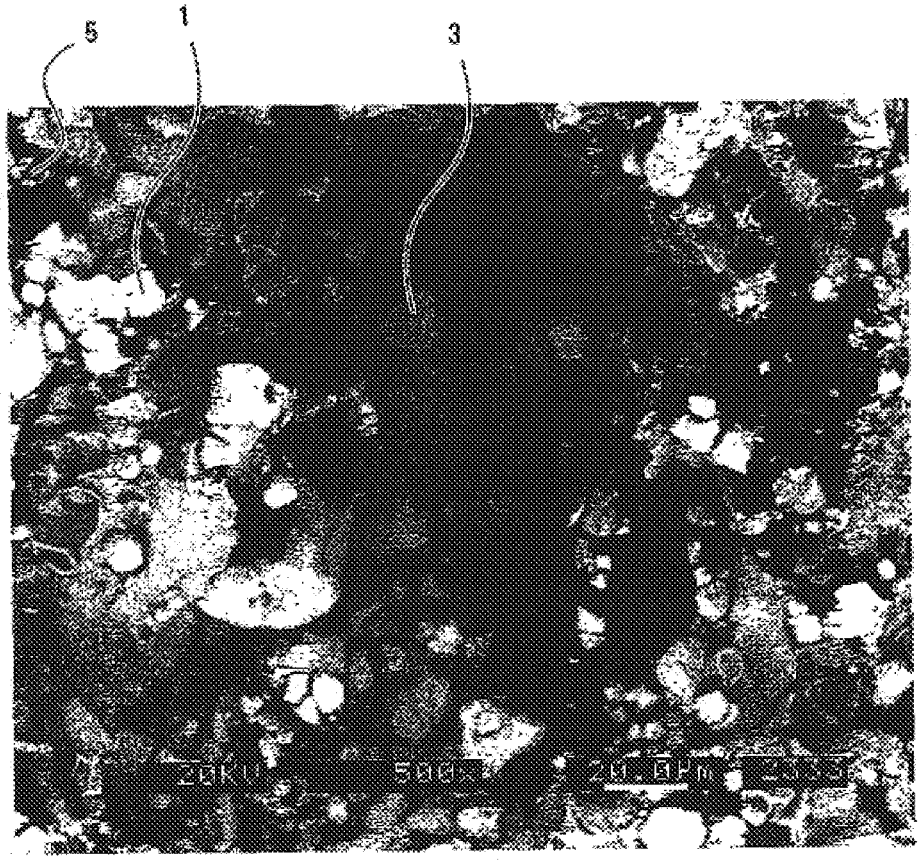
FIG. 1 is an image from a scanning electron microscope (SEM) of the fracture surface of a tungsten/tin/PTFE composite.

A composite consisting essentially of about 65% tungsten, about 33% tin, about 1% polytetrafluoro-ethylene (PTFE)

and about 1% aluminum was formed by mixing the constituents and pressing the mixture in a compaction press of rectangular geometry at a pressure of 40 tsi. (Amounts are given as percent by weight based on the total weight of the composite.) The sample was sintered to a density of about 11.3 g/cc (Archimides density) at about 220° C. The transverse rupture strength of the composite was determined to be about 24 MPa. FIG. 1 is an image from a scanning electron microscope (SEM) of the fracture surface of this composite. FIG. 1 shows tungsten grains (1) bonded together in a tin matrix (3) with some flecks of PTFE (5) visible.

Example 2

Composite—Intimate Mixing of Zinc Stearate by Die Compaction

A solid object consisting essentially of about 74% tungsten, about 25.75% tin, about 0.25% zinc stearate was formed by mixing the constituents and pressing the mixture in a 60 ton Gasbarre Press™ under a pressure of 35 tsi and at a temperature of 100° C. (Amounts are given as percent by weight based on the total weight of the composite.) The solid object formed had a density of 13 g/cc (Archimides density).

Example 3

Injection Moulding Process

Figure 2:
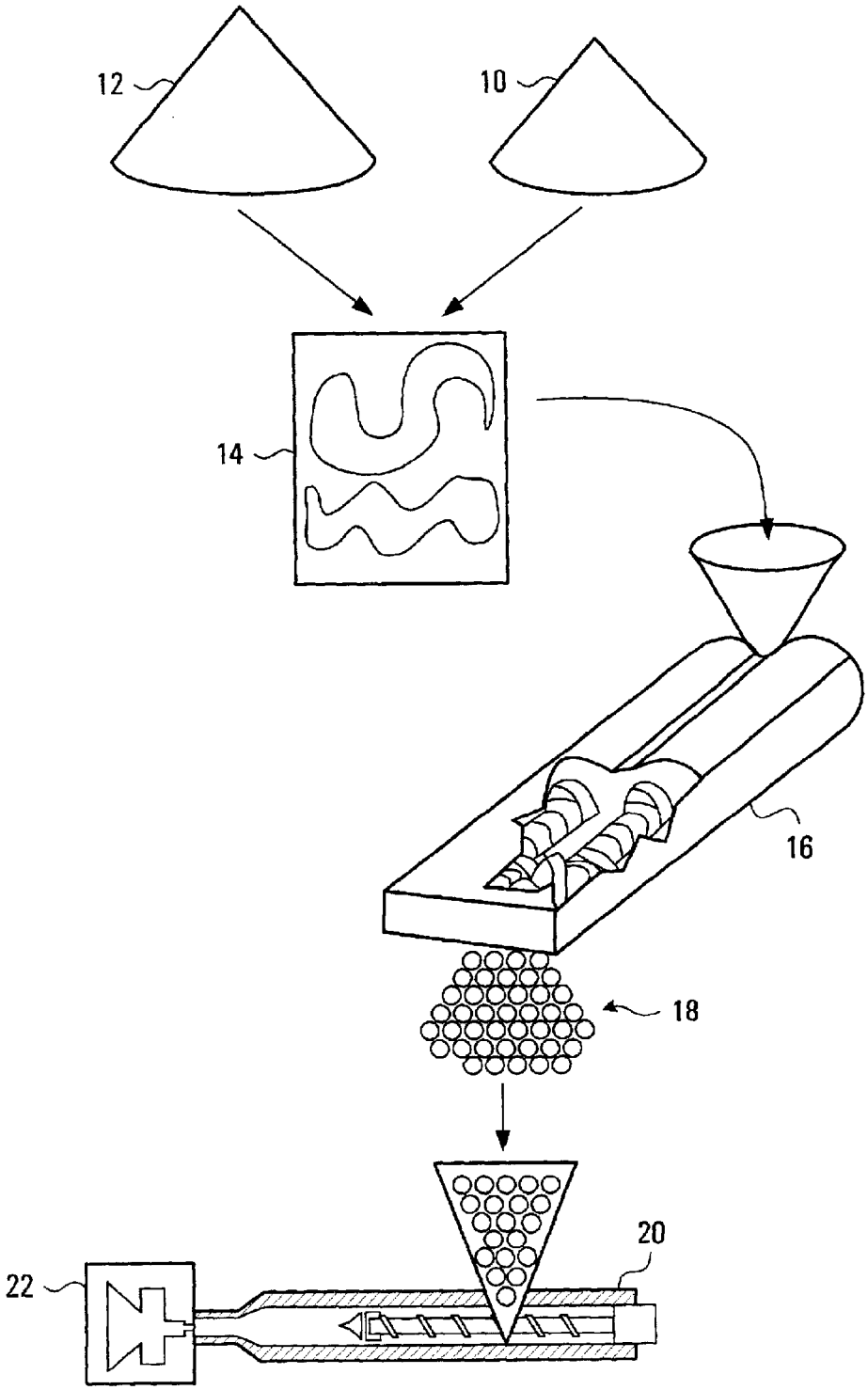
FIG. 2 is a diagram depicting an injection moulding process.

FIG. 2 is a diagram depicting an injection moulding process which is suitable for the formation of articles such as wheel weights and bullets. In FIG. 2, binder (10) comprises tin, organic polymer (such as PTFE) and, optionally, other additives for holding tungsten particles together. Tungsten particles (12), which may be in the form of a powder, and the binder are premixed in a pre-mixer (14) to form a pre-mixture. The pre-mixture is then charged into a compounder (16) where the suspension is further mixed at an elevated temperature (about 250° C. to about 270° C.) and pelletized. The pelletized composite (18) is then charged into an injection moulder (20) where the molten tin-rich phase carries the suspended tungsten particles into the mould of the desired shape (22) (e.g. a wheel weight) where the suspension is cooled and solidified.

Example 4

Extrusion Process for Producing Shot

Figure 3:
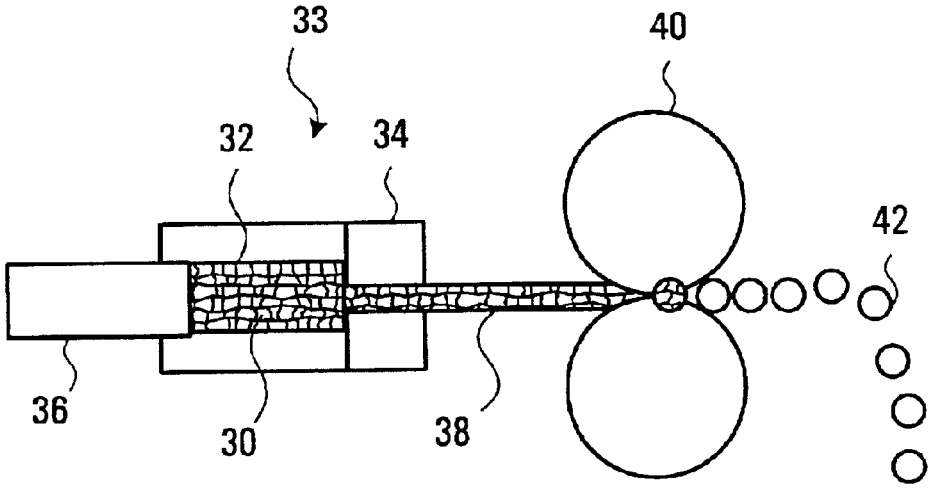
FIG. 3 is a diagram depicting a process for producing shot.

FIG. 3 is a diagram depicting a process for producing shot. A tungsten-tin-organic additive mixture (30) is charged into a heated barrel (32) of an extruder (33). The tungsten-tin-organic additive mixture may be a simple mixture; or, it may be in pelletized form as described in Example 3. The heated mixture (30) is forced through a die plate (34) by a plunger (36) and extruded into a sheet (38). The extruded sheet (38) is fed through two spinning rolls (40). The spinning rolls (40) have a dimpled texture to cut into the heated sheet (38) and form spheres (42) which are separated from each other and finished into shot.

Example 5

Composite—Use of Organic Polymer as Coating on Simple Tin/Tungsten/Organic Additive Solid Object A solid object consisting essentially of about 40% tungsten, about 59.75% tin, about 0.25% zinc stearate was formed by mixing the constituents and pressing the mixture in a 60 ton Gasbarre Press™ under a pressure of 30 tsi and at a temperature of 100° C. (Amounts are given as percent by weight based on the total weight of the composite.) The solid object formed was then coated with a commercial fluoropolymer emulsion (DryFilm™ from DuPont) by dipping and sintered at 235° C. under an $N_2$ atmosphere for 1 hour. The object formed had a density of 9.4 g/cc (Archimides density).

Example 6

Composite—Use of Organic Polymer as Coating on (Tin-Aluminum Alloy)/Tungsten/(Organic Additive) Solid Object Powders of tin and tungsten were mixed together and pressed, using the die compaction process with heating at a temperature below the melting point of tin, in the shape of bullets or rectangular test bars in the composition shown below:

| Powder | Fractional wt. | Density (g/cc) |
|---|---|---|
| Tungsten | 0.6 | 19.3 |
| Tin | 0.37 | 7.28 |
| Zinc stearate | 0.003 | 1 |
| Copper | 0.005 | 8.94 |
| Aluminum | 0.002 | 2.702 |
| Carbon | 0.004 | 2.25 |
| Copper (I) oxide | 0.016 | 6.2 |

The components were coated with a commercial fluoropolymer emulsion (DryFilm™ from DuPont) and heated up to a temperature of 240° C. A sintered density of 11 g/cc was obtained. No tin segregated from the polymer-coated components. The transverse rupture strength (TRS) of the composite was 100 MPa.

Figure 4:
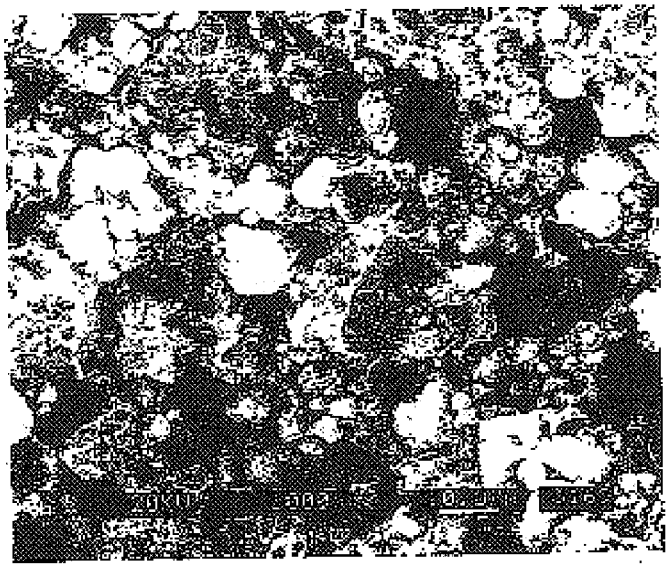
FIG. 4 is an electron micrograph of the fracture surface of a composite made by coating a tin/tungsten mixture with DryFilm™ and heating the composite to above the melting point of tin.
Figure 5:
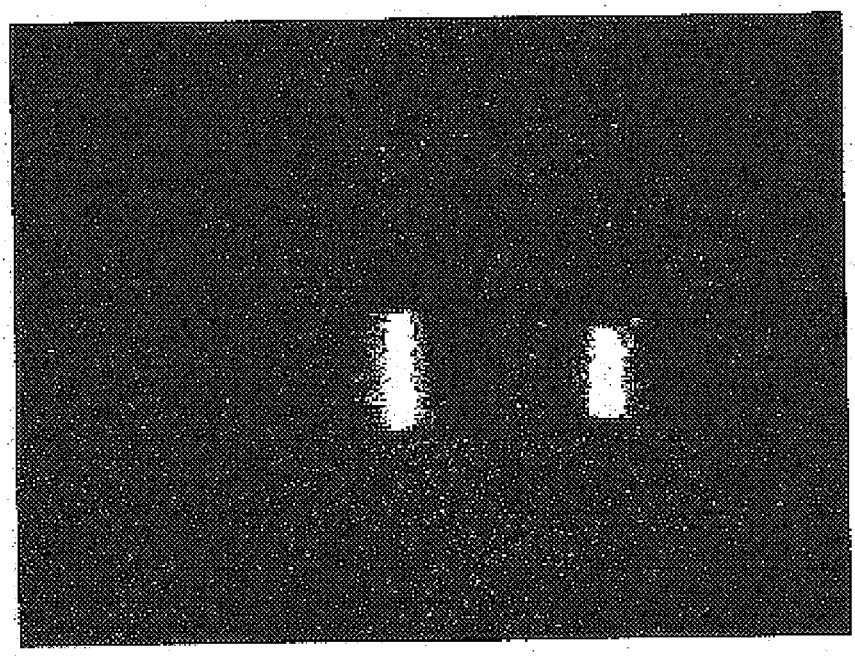
FIG. 5 is a photograph showing that a bullet made by a process of the present invention will exhibit some flattening when struck repeatedly by a hammer.

In contrast, tin migrated out of uncoated specimens heated to this temperature. Further, the TRS of the uncoated composite prior to sintering was 85 MPa. Still further, the TRS of the coated composite sintered at 220° C. was found to be 80 MPa. The microstructure of the fracture surface provides some evidence of ductile failure compared to brittle failure in the absence of polymer-coating followed by sintering above the melting point of tin (FIG. 4). A tin-tungsten bullet fabricated by the new technique subjected to repeated impact from a hammer displayed some flattening at the tip prior to failure (FIG. 5). In contrast, tin-tungsten bullets having no organic polymer and prepared without the new processing route disintegrated after the first impact from a similar hammer blow.

Example 7

Figure 6:
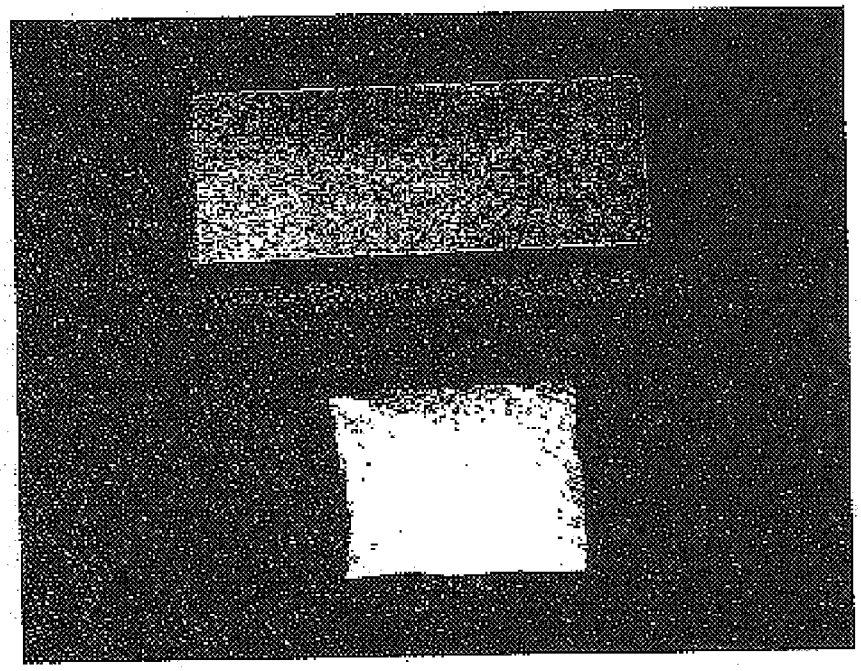
FIG. 6 is a photograph showing that a bar made by a process of the present invention will exhibit some denting without fracture when struck repeatedly by a hammer.

Composite—Use of Organic Polymer as Coating on (Tin-Silver Alloy)/Tungsten/(Organic Additive) Solid Object A solid object consisting essentially of about 57.5% tungsten, about 21% tin, about 21% tin-silver pre-alloyed powder and about 0.5% zinc stearate was formed. (Amounts are given as percent by weight based on the total weight of the composite.) The tin-silver pre-alloyed powder used was −100 mesh powder with the ratio of tin to silver being 96.5 to 3.5 per cent by weight and a melting point of 221° C. The constituents were mixed and pressed in a 60 ton Gasbarre Press™ under a pressure of 35 tsi and at a temperature of 100° C. The solid object formed was then coated with DryFilm™ by dipping and sintered at 235° C. under an $N_2$ atmosphere for 1 hour. The object formed had a density of 10.75 g/cc (Archimides density). A tin-tungsten bar fabricated by the new technique subjected to repeated impact from a hammer displayed only moderate denting (FIG. 6).

Example 8

Composite—Use of Organic Polymer as Coating on (Tin-Bismuth Alloy)/Tungsten/(Organic Additive) Solid Object A solid object consisting essentially of about 57% tungsten, about 38.5% tin, about 2.5% bismuth, about 1.5% copper, about 0.25aluminum and about 0.25% zinc stearate was formed. (Amounts are given as percent by weight based on the total weight of the composite.) The constituents were mixed and pressed in a 60 ton Gasbarre Press™ under a pressure of 35 tsi and at a temperature of 100° C. The solid object formed was then coated with DryFilm™ by dipping and sintered at 235° C. under an $N_2$ atmosphere for 1 hour. The object formed had a density of 10.5 g/cc (Archimides density).

Figure 7:
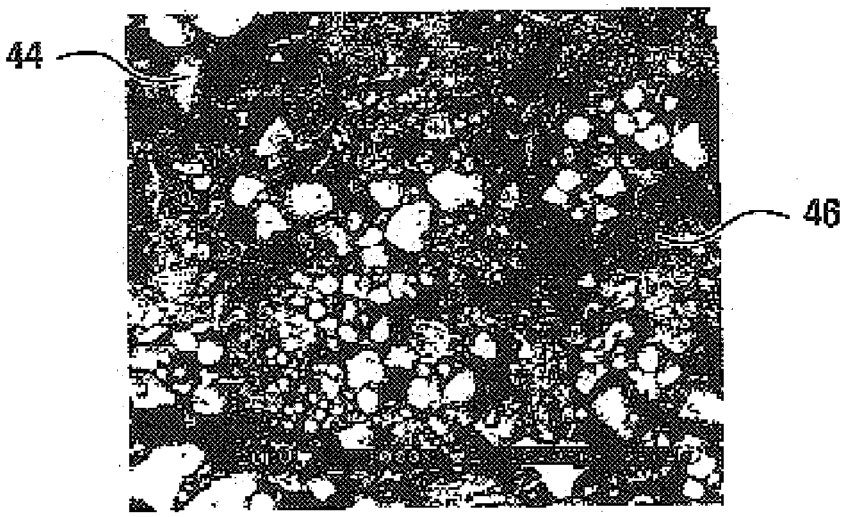
FIG. 7 is an electron micrograph of the fracture surface of a composite made by coating a tin/tungsten/zinc stearate mixture with DryFilm™ and heating the composite to above the melting point of tin.

FIG. 7 is an electron micrograph image showing tungsten grains (44) bonded together in a tin-bismuth alloy matrix (46).

Figure 8:
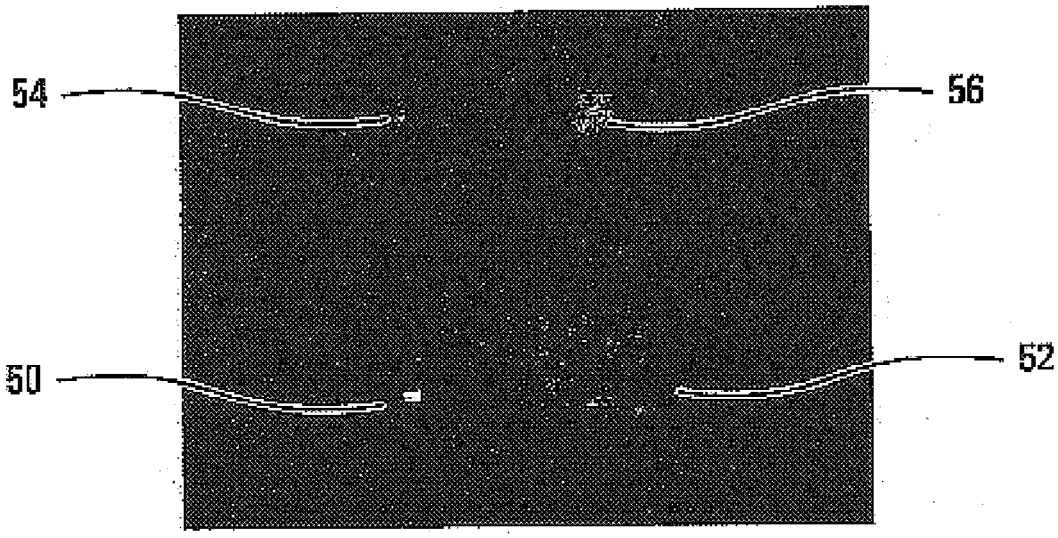
FIG. 8 is a photograph comparing the deformation of a green shot consisting of tin, tungsten and zinc stearate prepared by die compaction and a shot made by coating a tin/tungsten/zinc stearate composite with DryFilm™ and heating the composite to above the melting point of tin.

FIG. 8 provides a comparison of the ductility of the (tin-bismuth alloy)/tungsten/zinc stearate solid object in its green form (50, 52) versus its coated and sintered (at 235° C.) form (54, 56). The transverse rupture strength of the coated object (54) was measured at 96 MPa (56). The green object (50) subjected to the same pressure disintegrated (52).

It is apparent to one skilled in the art that many variations on the present invention can be made without departing from the scope or spirit of the invention claimed herein.

What is claimed is:

1. A composite comprising tungsten, tin and a polyfluorinated hydrocarbon.

2. The composite of claim 1, wherein the polyfluorinated hydrocarbon is intimately mixed with the tungsten and tin.

3. The composite of claim 1, wherein the tungsten is present in an amount of 40–74% by weight of the composite, the tin is present in an amount of 25–59% by weight of the composite and the polyfluorinated hydrocarbon is present in an amount of 0.1–2% by weight of the composite.

4. The composite of claim 1, wherein the tungsten is present in an amount of 55–69% by weight of the composite, the tin is present in an amount of 30–44% by weight of the composite and the polyfluorinated hydrocarbon is present in an amount of 0.5–1% by weight of the composite.

5. The composite of claim 1, further comprising aluminum, silver, bismuth or copper.

6. The composite of claim 1, wherein the polyfluorinated hydrocarbon comprises polytetrafluoroethylene.

7. The composite of claim 1, wherein the tungsten and tin are present in a core and the polyfluorinated hydrocarbon is present in the core, in a coating on the core, or in both the core and the coating.

8. The composite of claim 1 consisting essentially of about 65% by weight tungsten, about 33% by weight tin, about 1% by weight polyfluorinated hydrocarbon, and about 1% by weight aluminum, silver, bismuth or copper, all weights based on weight of the composite.

9. A composite comprising: a core comprising tungsten and tin; and, a coating comprising a low surface energy organic polymer having a melting point higher than the melting point of tin.

10. The composite of claim 9, wherein the low surface energy organic polymer is a polyfluorinated hydrocarbon.

11. The composite of claim 9, wherein the low surface energy organic polymer is polytetrafluoroethylene.

12. The composite according to claim 9, wherein the tungsten is present in an amount of 40–74% by weight of the composite, the tin is present in an amount of 25–59% by weight of the composite and the polyfluorinated hydrocarbon is present in an amount of 0.1–2% by weight of the composite.

13. The composite of claim 9, wherein the tungsten is present in an amount of 55–69% by weight of the composite, the tin is present in an amount of 30–44% by weight of the composite and the polyfluorinated hydrocarbon is present in an amount of 0.5–1% by weight of the composite.

14. The composite according to claim 9, wherein the core further comprises a metal stearate, ethylene-bis-stearamide or a blend thereof.

15. The composite according to claim 9, wherein the core further comprises aluminum, silver, bismuth or copper.

16. The composite of claim 9 comprising a core consisting essentially of tungsten and tin and a shell consisting essentially of a low surface energy organic polymer having a melting point higher than the melting point of tin.

17. The composite according to claim 16, wherein the low surface energy organic polymer is polytetrafluoroethylene.

* * * * *